US007317890B2

(12) United States Patent
Kyung

(10) Patent No.: US 7,317,890 B2
(45) Date of Patent: Jan. 8, 2008

(54) APPARATUS FOR AND METHOD OF PRINTING A MONO-COLOR IMAGE USING A SINGLE-PASS COLOR PRINTER

(75) Inventor: Myung-Ho Kyung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 331 days.

(21) Appl. No.: 11/188,987

(22) Filed: Jul. 26, 2005

(65) Prior Publication Data

US 2006/0093409 A1 May 4, 2006

(30) Foreign Application Priority Data

Oct. 28, 2004 (KR) ..... 10-2004-0086546

(51) Int. Cl.
*G03G 15/01* (2006.01)

(52) U.S. Cl. ..... 399/299; 399/302; 399/303; 399/308

(58) Field of Classification Search ..... 399/66, 399/297, 298, 299, 301, 302, 303, 308
See application file for complete search history.

(56) References Cited

U.S. PATENT DOCUMENTS 6,134,402 A 10/2000 Nakayama et al.
6,466,761 B1 * 10/2002 Rene et al. ..... 399/308
6,470,154 B1 10/2002 Shinohara
6,553,192 B2 4/2003 Maebashi
7,003,238 B2 * 2/2006 Yoshida et al. ..... 399/66

FOREIGN PATENT DOCUMENTS

| | | |
|---|---|---|
| JP | 04-278968 | 10/1992 |
| JP | 2001-125456 | 5/2001 |
| JP | 2002-296868 | 10/2002 |
| JP | 2003-114561 | 4/2003 |
| KR | 10-0429809 | 7/2003 |
| KR | 1020030063534 | 7/2003 |

* cited by examiner

*Primary Examiner*—Hoan Tran
(74) *Attorney, Agent, or Firm*—Roylance, Abrams, Berdo & Goodman, LLP

(57) ABSTRACT

Apparatus and method are provided for printing a mono-color image using a single-pass color printer. According to the apparatus and method, dummy toner images are developed onto the photosensitive substances that do not perform an image forming operation so as to correspond to a non-image region of an intermediate transfer belt (or a carrying belt), thus friction between a blade and the photosensitive substances that are not related to the image forming operation can be reduced.

18 Claims, 4 Drawing Sheets

APPARATUS FOR AND METHOD OF PRINTING A MONO-COLOR IMAGE USING A SINGLE-PASS COLOR PRINTER

PRIORITY

This application claims the benefit under 35 U.S.C. 119(a) of Korean Patent Application No. 10-2004-0086546, filed on Oct. 28, 2004, in the Korean Intellectual Property Office, the entire disclosure of which is incorporated herein by reference.

BACKGROUND OF THE INVENTION

1. Field of the Invention

The present invention relates to an apparatus for and method of printing. More particularly, the present invention relates to an apparatus for and method of printing a mono-color image in a single-pass color printer.

2. Description of the Related Art

An electrophotographic printer prints an image through processes of an exposure, a development, a transfer, a fusing, and a cleaning. Referring to FIG. 1, light corresponding to image information is irradiated onto a photosensitive drum 1 using an exposing unit 2 (exposure) to form an electrostatic latent image. The developer 3 supplies toner to the electrostatic latent image to form a toner image (development). The toner image is transferred and fused onto a sheet of paper (P) directly or through an intermediate transfer belt 4 to print the image. After performing the transfer process, a blade 5 of FIG. 1 is installed to be in contact with the photosensitive drum 1 in order to remove waste toner remaining on the photosensitive drum 1. The blade 5 is generally formed of a rubber material having elasticity such as urethane.

A single-pass color printer generally includes four photosensitive drums 1, four exposing units 2 for forming the electrostatic latent images on the four photosensitive drums 1, and four developers 3 for supplying toners of black (K), cyan (C), magenta (M), and yellow (Y) colors to the electrostatic latent images formed on the photosensitive drums 1 to develop the images. The four photosensitive drums 1 contact the intermediate transfer belt 4. The toner images of K, C, M, and Y colors formed on the four photosensitive drums 1 are transferred onto the intermediate transfer belt 4 while overlapping with each other to form a color toner image. When the color toner image is transferred and fused onto the paper, the full-color image is printed on the paper.

The single-pass color printer can also print a mono-color image. In a case where the mono-color image is printed, the toner image is developed on one photosensitive drum 1 only. However, the photosensitive drums that are not engaged with the image forming operation should be rotated since these contact the intermediate transfer belt 4.

There is a problem in the prior art in that the waste toner functions as a lubricant between the photosensitive drum 1 and the blade 5. However, since the toner image is not developed on the photosensitive drums 1 that are not engaged with the image forming operation, the waste toner is rarely generated. Therefore, the photosensitive drums 1 that are not related to the image forming operation may be damaged by the friction between the photosensitive drum 1 and the blade 5. In addition, the blade 5 may be bent as shown in FIG. 1 by the dotted line.

SUMMARY OF THE INVENTION

The present invention provides an apparatus for and method of printing a mono-color image. The apparatus and method prevent a photosensitive drum from being damaged or a blade from being overturned when a mono-color image is printed using a single-pass color printer.

According to an aspect of the present invention, an apparatus for and method of printing a mono-color image using a single-pass color printer are provided. The apparatus comprise a plurality of photosensitive substances, on which a plurality of toner images of different colors are formed, an intermediate transfer belt for rotating while contacting the plurality of photosensitive substances, a plurality of transfer units for facing the plurality of photosensitive substances to provide a rear surface of the intermediate transfer belt with an electric field, and a plurality of blades for contacting the plurality of photosensitive substances to remove toner remaining on the photosensitive substances after performing a transfer process. The method comprises developing dummy toner images onto the photosensitive substances that do not perform an image forming operation to correspond to a non-image region of the intermediate transfer belt, to which a toner image transferred from the photosensitive substance performing the image forming operation is not attached, in order to reduce a friction between the blade and the photosensitive substances that are not related to the image forming operation, if a mono-color image is printed.

According to another aspect of the present invention, an apparatus for and method of printing a mono-color image using a single-pass color printer are provided. The apparatus comprises a plurality of photosensitive substances, on which a plurality of toner images of different colors are formed, a carrying belt for facing the plural photosensitive substances and rotating to support a back surface of paper, on which the plural toner images will be transferred, a plurality of transfer units for facing the plurality of photosensitive substances to provide a rear surface of the intermediate transfer belt with an electric field, and a plurality of blades for contacting the plurality of photosensitive substances to remove toner remaining on the photosensitive substances after performing a transfer process. The method comprises developing dummy toner images on the photosensitive substances that do not perform an image forming operation so as to correspond to a non-image region of the carrying belt, which does not support the paper, to reduce friction between the blade and the photosensitive substances that do not perform the image forming operation, if a mono-color image is printed.

The transfer unit facing the photosensitive substance performing the image forming operation may provide the toner image with a transfer electric field of opposite polarity to that of the toner image, and the transfer units facing the photosensitive substances not performing the image forming operation are powered off.

The transfer unit facing the photosensitive substance performing the image forming operation may provide the toner image with a transfer electric field of opposite polarity to that of the toner image, and the transfer units facing the photosensitive substances not performing the image forming operation may provide the dummy toner images with a reverse-transfer electric field having the same polarity as that of the dummy toner images.

A length of the dummy toner image in a main scanning direction may be the same as a length of the blade or longer.

BRIEF DESCRIPTION OF THE DRAWINGS

The above and other features and advantages of the present invention will become more apparent by describing in detail exemplary embodiments thereof with reference to the attached drawings in which.

Throughout the drawings, the same element is designated by the same reference numeral or character.

DETAILED DESCRIPTION OF EXEMPLARY EMBODIMENTS

Figure 2:
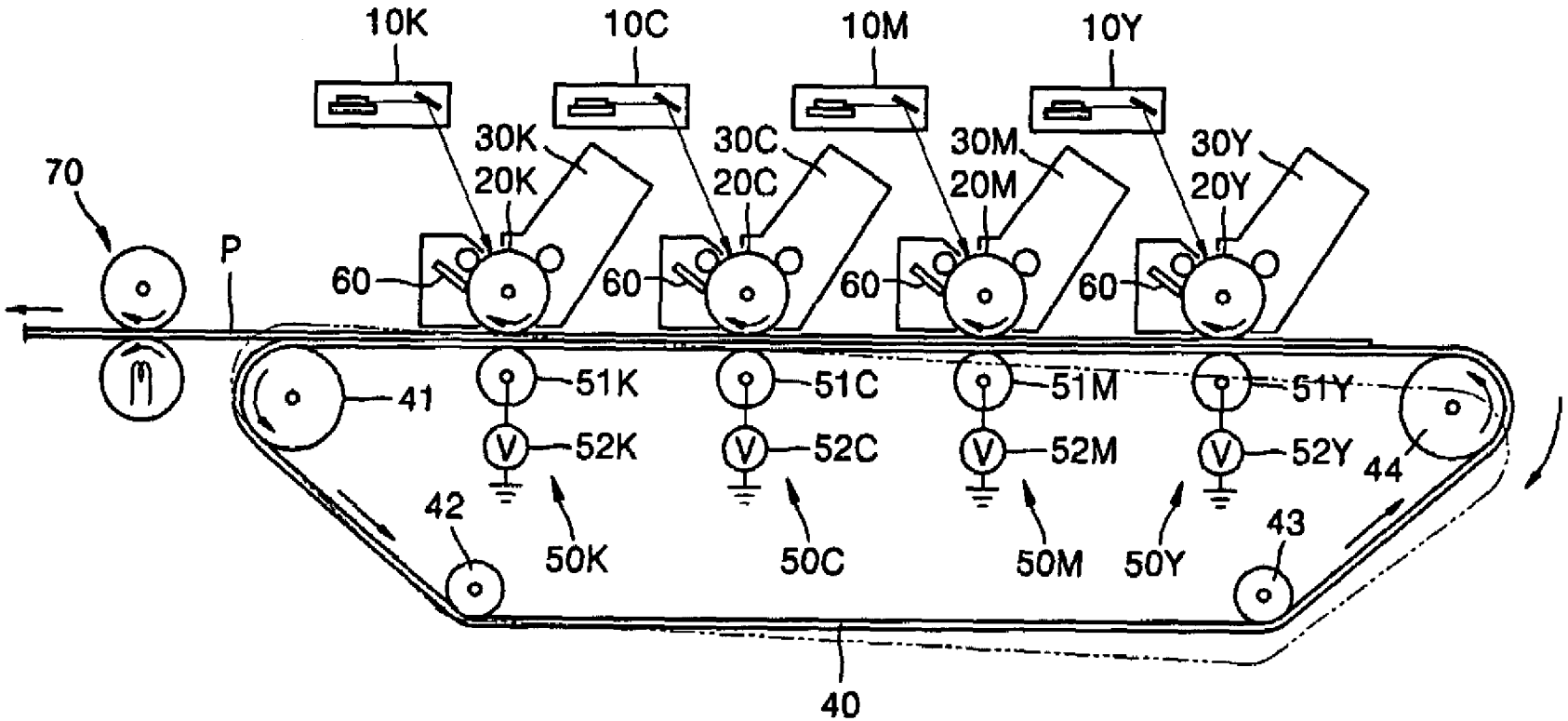
FIG. 2 is a schematic view of a single-pass color printer using a method of printing mono-color image according to an embodiment of the present invention.
Figure 3:
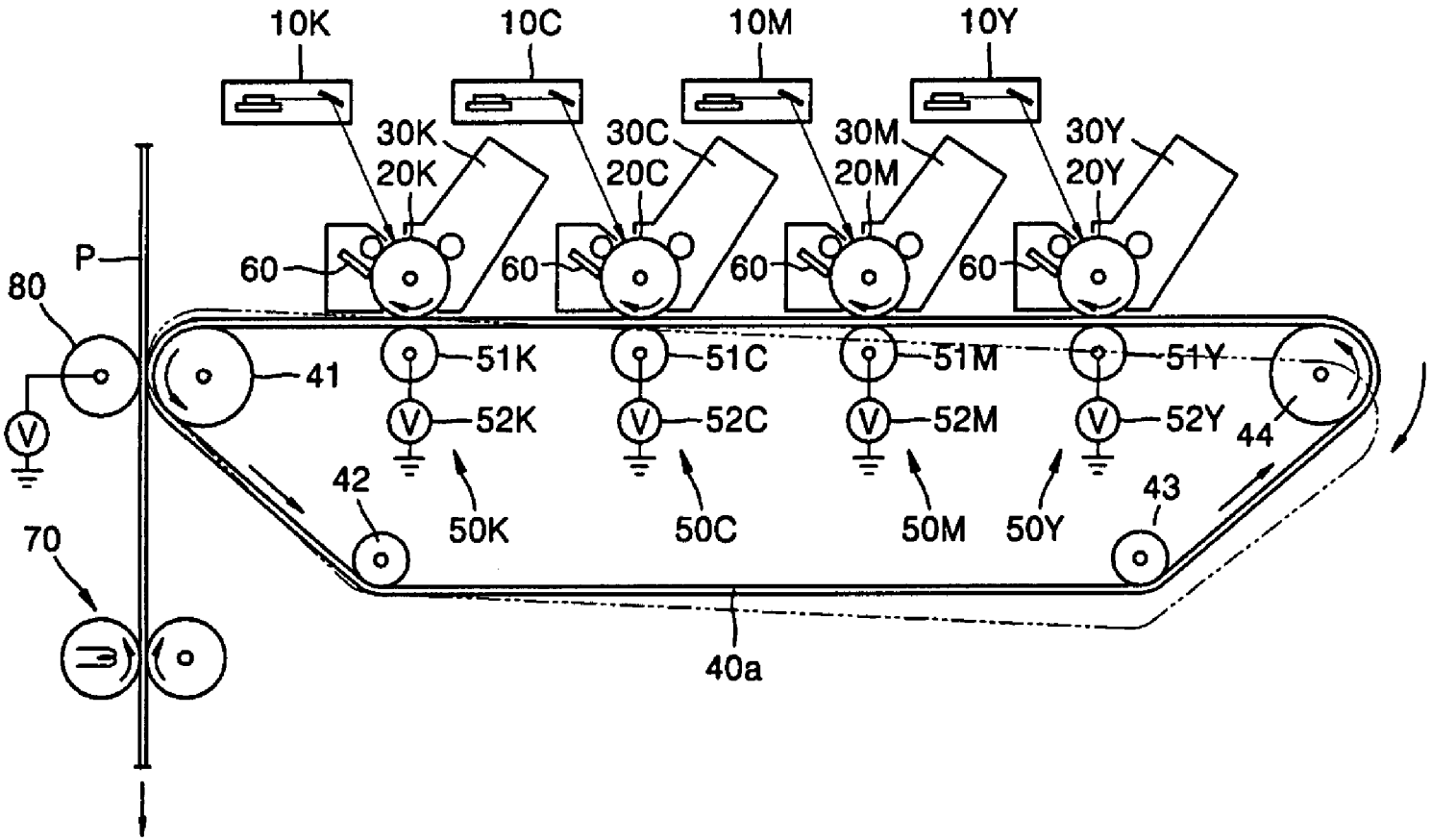
FIG. 3 is a schematic view of another example of single-pass color printer using the method of printing mono-color image according to an embodiment of the present invention.

FIGS. 2 and 3 are schematic views of examples of a single-pass color printer according to embodiments of the present invention. Referring to FIG. 2, the printer comprises four exposing units 10K, 10C, 10M, and 10Y, and four photosensitive drums 20K, 20C, 20M, 20Y. The exposing units 10K, 10C, 10M, and 10Y scan lights corresponding to image information of black (K), cyan (C), magenta (M), and yellow (Y) colors onto the photosensitive drums 20K, 20C, 20M, and 20Y to form electrostatic latent images. Developers 30K, 30C, 30M, and 30Y supply toners of K, C, M, and Y colors to the electrostatic latent images formed on the photosensitive drums 20K, 20C, 20M, and 20Y to develop the images. Then, toner images of K, C, M, and Y colors are respectively formed on the photosensitive drums 20K, 20C, 20M, and 20Y. A sheet of paper (P) is attached onto a carrying belt 40 by static electricity.

The carrying belt 40 faces the photosensitive drums 20K, 20C, 20M, and 20Y, and conveys the paper (P). The photosensitive drums 20K, 20C, 20M, and 20Y contact the paper (P) or the carrying belt 40. Transfer units 50K, 50C, 50M, and 50Y respectively comprise transfer rollers 51K, 51C, 51M, and 51Y for facing the photosensitive drums 20K, 20C, 20M, and 20Y, and voltage applying units 52K, 52C, 52M, and 52Y applying voltages to the transfer rollers 51K, 51C, 51M, and 51Y. When the voltage applying units 52K, 52C, 52M, and 52Y apply transfer voltages having opposite polarities against the polarities of toner images to the transfer rollers 51K, 51C, 51M, and 51Y, transfer electric fields are formed on a back surface of the carrying belt 40. The toner images of K, C, M, and Y colors formed on the photosensitive drums 20K, 20C, 20M, and 20Y are transferred onto the paper (P) while overlapping with each other, thus a full-color toner image is formed on the paper (P). A fuser 70 fuses the full-color toner image onto the paper (P) by applying heat and pressure to the full-color toner image. The printing operation of the full-color image is completed through the above processes. The blade 60 contacts the photosensitive drums 20K, 20C, 20M, and 20Y to remove the toner remaining on the surfaces of the photosensitive drums 20K, 20C, 20M, and 20Y after transferring the toner image onto the paper (P).

The single-pass image forming apparatus of FIG. 3 has the same structure as that of the apparatus shown in FIG. 2, with the exception that the toner image is transferred onto an intermediate transfer belt 40*a* and finally transferred onto the paper that is conveyed between a transfer backup roller 80 and the intermediate transfer belt 40*a*. A transfer voltage of opposite polarity to that of the toner image is applied to the transfer backup roller 80.

Figure 1:
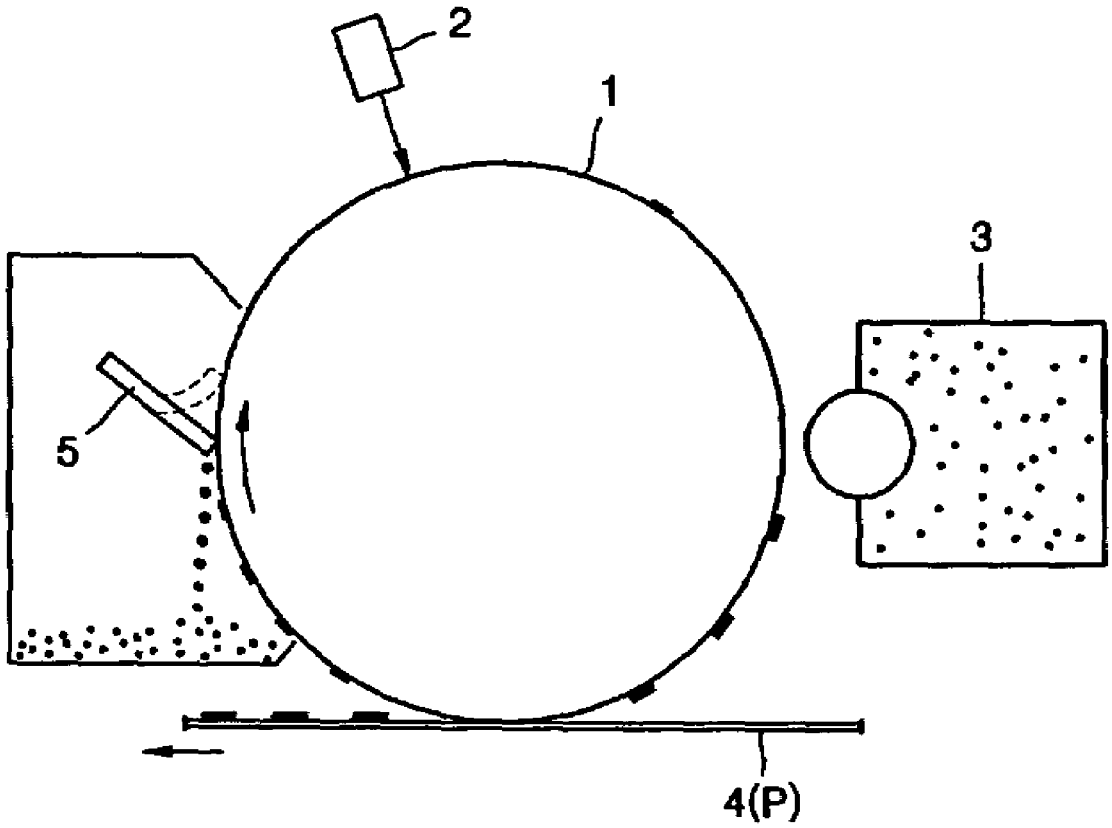
FIG. 1 (PRIOR ART)
FIG. 1 is a diagram of a conventional printer illustrating a blade that is bent.

In a case where a mono-color image, for example, an image of K color is printed by the single-pass color printer, a toner image of K color is developed only on the photosensitive drum 20K. The photosensitive drums 20C, 20M, and 20Y that are not related to the image forming operation should be rotated since these contact the carrying belt 40 (or intermediate transfer belt 40*a*). Since the toner image is not developed on the photosensitive drums 20C, 20M, and 20Y, the waste toner is rarely generated. Therefore, the photosensitive drums 20C, 20M, and 20Y may be damaged by the friction with the blade 60. In addition, the blade 60 may be overturned as shown in FIG. 1 by the dotted line.

Therefore, the carrying belt 40 (or the intermediate transfer belt 40*a*) may be slanted as shown by the dotted line in FIGS. 2 and 3 in order to separate the belt 40 or 40*a* from the photosensitive drums 20C, 20M, and 20Y, and the photosensitive drums 20C, 20M, and 20Y are not rotated. If the carrying belt 40 (or intermediate transfer belt 40*a*) is slanted, there are some problems.

That is, in order to slant the carrying belt 40 (or intermediate transfer belt 40*a*), a very complex device for moving the transfer units 50K, 50C, 50M, and 50Y, the transfer backup roller 80, and supporting rollers 41, 42, 43, and 44 that support the carrying belt 40 (or intermediate transfer belt 40*a*) is required. In addition, a control unit is required to control the driving power supplied to the photosensitive drums 20K, 20C, 20M, and 20Y. Therefore, the structure of the printer becomes complex and expensive.

In addition, in the printer of FIG. 2, if the carrying belt 40 is slanted, a path of the paper entering the carrying belt 40 for being transferred and a path of paper entering the fuser 70 after the transfer become different from those of a case where the carrying belt 40 is not slanted. In addition, the paper (P) is conveyed only by the carrying belt 40 until the paper (P) reaches the photosensitive drum 20K, since the photosensitive drums 20C, 20M, and 20Y cannot participate in the conveying of the paper (P). In the printer of FIG. 3, if the intermediate transfer belt 40*a* is slanted, the proceeding path of the paper entering between the transfer backup roller 80 and the intermediate transfer belt 40*a* and the proceeding path of the paper entering the fuser 80 after the transfer become different from those of a case where the intermediate transfer belt 40*a* is not slanted. Therefore, it is not easy to convey the paper stably, and a jam may occur.

In a case where the mono-color image of the color that is first transferred (Y color in FIGS. 2 and 3) or last transferred (K color in FIGS. 2 and 3), the carrying belt 40 (or the intermediate transfer belt 40*a*) can be separated from the photosensitive drums 20C, 20M, and 20Y, or 20K, 20C, and 20M that do not perform the image forming operation by slanting the belt 40 or 40*a*. However, in a case where the mono-color image of the color that is transferred second or third (C or M color in FIGS. 2 and 3), it is difficult or impossible to separate the carrying belt 40 (or intermediate transfer belt 40*a*) from the photosensitive drums 20K, 20M, and 20Y, or 20K, 20C, and 20Y that do not perform the image forming operation.

Thus, embodiments of the present invention provide a method of printing the mono-color image as follows. For example, in a case where the black color image is printed, K-color toner image is developed on the photosensitive drum 20K, and C, M, and Y-color dummy toner images are developed respectively on the photosensitive drums 20C, 20M, and 20Y. The dummy toner image is formed to correspond to a non-image region of the carrying belt 40 (or the intermediate transfer belt 40*a*). The non-image region is the area that does not comprise an image region, to which the black color toner image is transferred.

Figure 4:
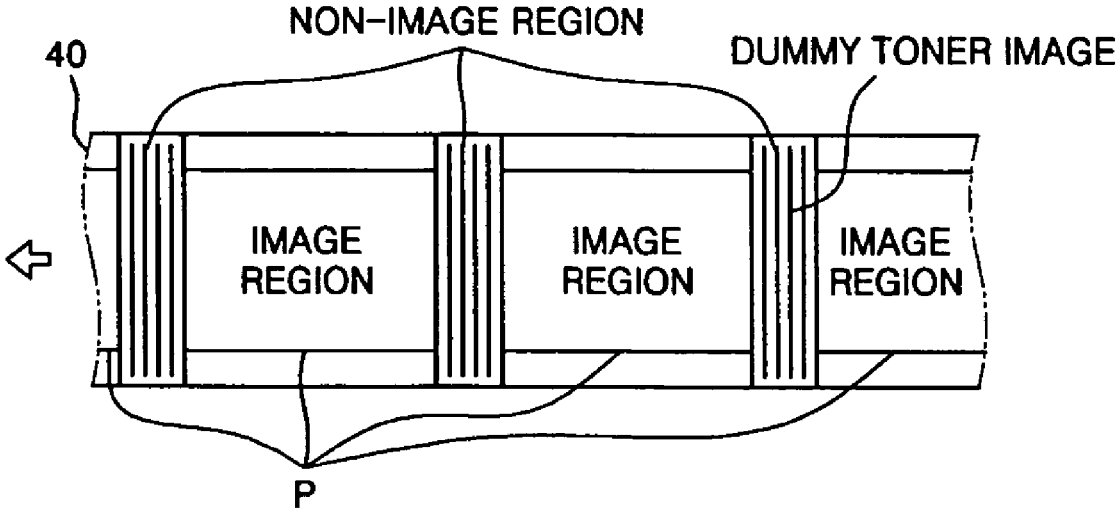
FIGS. 4 and 5 are diagrams illustrating non-image regions.
Figure 5:
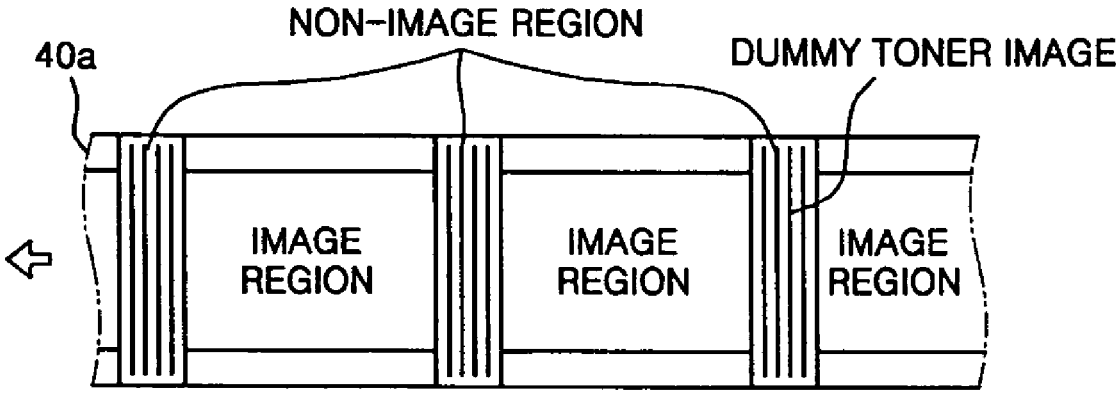

Referring to FIG. 4, plural sheets of paper (P) are attached to and conveyed by the carrying belt 40 due to electrostatic force. The paper (P) is the image region, to which the K-color toner image developed on the photosensitive drum 20K is transferred. The plural sheets of paper (P) cannot be conveyed continuously, and a gap exists between the sheets of paper (P), the gap is referred to as the non-image region. Referring to FIG. 5, a plurality of image regions, to which the K-color toner image is transferred, exist on the intermediate transfer belt 40*a*. The gaps between the plurality of image regions are the non-image regions.

The dummy toner image is formed to correspond to the non-image region, that is, when the non-image region passes through a transfer nip, where the photosensitive drums 20C, 20M, and 20Y face the carrying belt 40 (or intermediate transfer belt 40*a*), the dummy toner image also passes through the transfer nip. Thus, contamination of K-color toner image by the C, M, and Y-color dummy toner images can be prevented.

The transfer unit 50K facing the photosensitive drum 20K that performs the image forming operation provides the K-color toner image with the transfer electric field having the opposite polarity to the K-color toner image in order to transfer the K-color toner image onto the image region. The transfer units 50C, 50M, and 50Y facing the photosensitive drums 20C, 20M, and 20Y that do not perform the image forming operation are powered off. Therefore, the dummy toner images are not transferred onto the image region. The dummy toner images are removed from the photosensitive drums 20C, 20M, and 20Y by the blade 60. Thus, the dummy toner images function as lubricant that reduces the friction between the blade 60 and the photosensitive drums 20C, 20M, and 20Y. Therefore, damage of the photosensitive drums 20C, 20M, and 20Y that do not perform the image forming operation can be prevented, and the overturn of the blade 60 can also be prevented. A part of the dummy toner image may be attached onto the non-image region of the carrying belt 40 (or the intermediate transfer belt 40*a*) while passing through the transfer nip. The part of the dummy toner image attached on the non-image region cannot be used as the lubricant for reducing the friction between the photosensitive drums 20C, 20M, and 20Y and the blade 60. Since the dummy toner image is to be discarded, the usage amount should be minimized. The transfer units 50C, 50M, and 50Y facing the photosensitive drums 20C, 20M, and 20Y provide the dummy toner images with reverse-transfer electric fields having the same polarities as the dummy toner images in order to prevent the dummy toner images from being attached onto the non-image regions.

It is desirable that a length of the dummy toner image in a main scanning direction (width direction of the paper) is at least the same as the length of the blade 60 or longer in order to obtain even lubrication operation. In order to minimize the usage of toner, it is desirable that the dummy toner images are thin lines in the main scanning direction as shown in FIGS. 4 and 5.

According to the method of printing the mono-color image using the single-pass color printer, the dummy toner image is used as the lubricant. Thus damage to a photosensitive drum that does not perform the image forming operation and the bending of the blade can be prevented. In addition, the structure of the printer can be simplified, and the paper can be conveyed stably.

In addition, since the dummy toner images are formed to correspond to the non-image regions, the contamination of the image regions by the dummy toner images can be prevented.

Also, the amount of toner used can be reduced by applying the reverse-transfer electric field to the dummy toner image.

In addition, the dummy toner image is formed to be longer than the length of the blade in the main scanning direction, thus an even lubrication effect throughout the entire length of the blade can be obtained.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of printing a mono-color image using a single-pass color printer, which includes a plurality of photosensitive substances, on which a plurality of toner images of different colors are formed, an intermediate transfer belt for rotating while contacting the plurality of photosensitive substances, a plurality of transfer units facing the plurality of photosensitive substances to provide a rear surface of the intermediate transfer belt with an electric field, and a plurality of blades for contacting the plurality of photosensitive substances to remove toner remaining on the photosensitive substances after performing a transfer process, the method comprising:

developing dummy toner images onto the photosensitive substances that do not perform an image forming operation to correspond to a non-image region of the intermediate transfer belt, to which a toner image transferred from the photosensitive substance performing the image forming operation is not attached, in order to reduce a friction between the blade and the photosensitive substances that are not related to the image forming operation, if a mono-color image is printed.

2. The method of claim 1, wherein the transfer unit facing the photosensitive substance performing the image forming operation provides the toner image with a transfer electric field of opposite polarity to that of the toner image, and the transfer units facing the photosensitive substances not performing the image forming operation are powered off.

3. The method of claim 1, wherein the transfer unit facing the photosensitive substance performing the image forming operation provides the toner image with a transfer electric field of opposite polarity to that of the toner image, and the transfer units facing the photosensitive substances not performing the image forming operation provides the dummy toner images with a reverse-transfer electric field having the same polarity as that of the dummy toner images.

4. The method of claim 1, wherein a length of the dummy toner image in a main scanning direction is the same as a length of the blade or longer.

5. A method of printing a mono-color image using a single-pass color printer, which includes a plurality of photosensitive substances, on which a plurality of toner images of different colors are formed, a carrying belt for facing the plural photosensitive substances and rotating to support a back surface of paper, on which the plural toner images will be transferred, a plurality of transfer units for facing the plurality of photosensitive substances to provide a rear surface of the carrying belt with an electric field, and a plurality of blades for contacting the plurality of photosensitive substances to remove toner remaining on the photosensitive substances after performing a transfer process, the method comprising:

developing dummy toner images on the photosensitive substances that do not perform an image forming operation so as to correspond to a non-image region of the carrying belt, which does not support the paper, to reduce friction between the blade and the photosensitive substances that do not perform the image forming operation, if a mono-color image is printed.

6. The method of claim 5, wherein the transfer unit facing the photosensitive substance performing the image forming operation provides the toner image with a transfer electric field of opposite polarity to that of the toner image, and the transfer units facing the photosensitive substances not performing the image forming operation are powered off.

7. The method of claim 5, wherein the transfer unit facing the photosensitive substance performing the image forming operation provides the toner image with a transfer electric field of opposite polarity to that of the toner image, and the transfer units facing the photosensitive substances not performing the image forming operation provide the dummy toner images with a reverse-transfer electric field having the same polarity as that of the dummy toner images.

8. The method of claim 5, wherein a length of the dummy toner image in a main scanning direction is the same or substantially the same as a length of the blade or longer.

9. An apparatus for printing a mono-color image, comprising:

a plurality of photosensitive substances for forming a plurality of toner images of different colors;

an intermediate transfer belt for rotating while contacting the plurality of photosensitive substances;

a plurality of transfer units for facing the plurality of photosensitive substances to provide a rear surface of the intermediate transfer belt with an electric field;

a plurality of blades for contacting the plurality of photosensitive substances to remove toner remaining on the photosensitive substances after performing a transfer process; and a controller for developing dummy toner images onto the photosensitive substances that do not perform an image forming operation to correspond to a non-image region of the intermediate transfer belt, to which a toner image transferred from the photosensitive substance performing the image forming operation is not attached, in order to reduce a friction between the blade and the photosensitive substances that are not related to the image forming operation, if a mono-color image is printed.

10. The apparatus of claim 9, wherein the transfer unit facing the photosensitive substance performing the image forming operation provides the toner image with a transfer electric field of opposite polarity to that of the toner image, and the transfer units facing the photosensitive substances not performing the image forming operation are powered off.

11. The apparatus of claim 9, wherein the transfer unit facing the photosensitive substance performing the image forming operation provides the toner image with a transfer electric field of opposite polarity to that of the toner image, and the transfer units facing the photosensitive substances not performing the image forming operation provides the dummy toner images with a reverse-transfer electric field having the same polarity as that of the dummy toner images.

12. The apparatus of claim 9, wherein a length of the dummy toner image in a main scanning direction is the same or substantially the same as a length of the blade or longer.

13. The apparatus of claim 9, wherein the apparatus comprises a single-pass color printer.

14. An apparatus for printing a mono-color image, comprising:

a plurality of photosensitive substances for forming a plurality of toner images of different colors;

a carrying belt for facing the plural photosensitive substances and rotating to support a back surface of paper on which the plural toner images will be transferred;

a plurality of transfer units for facing the plurality of photosensitive substances to provide a rear surface of the carrying belt with an electric field, a plurality of blades for contacting the plurality of photosensitive substances and removing toner remaining on the photosensitive substances after performing a transfer process; and a controller for developing dummy toner images on the photosensitive substances that do not perform an image forming operation so as to correspond to a non-image region of the carrying belt, which does not support the paper, to reduce friction between the blade and the photosensitive substances that do not perform the image forming operation, if a mono-color image is printed.

15. The apparatus of claim 14, wherein the transfer unit facing the photosensitive substance performing the image forming operation provides the toner image with a transfer electric field of opposite polarity to that of the toner image, and the transfer units facing the photosensitive substances not performing the image forming operation are powered off.

16. The apparatus of claim 14, wherein the transfer unit facing the photosensitive substance performing the image forming operation provides the toner image with a transfer electric field of opposite polarity to that of the toner image, and the transfer units facing the photosensitive substances not performing the image forming operation provide the dummy toner images with a reverse-transfer electric field having the same polarity as that of the dummy toner images.

17. The apparatus of claim 14, wherein a length of the dummy toner image in a main scanning direction is the same or substantially the same as a length of the blade or longer.

18. The apparatus of claim 14, wherein the apparatus comprises a single-pass color printer.

* * * * *